US006273304B1

(12) United States Patent
Hoshino

(10) Patent No.: US 6,273,304 B1
(45) Date of Patent: Aug. 14, 2001

(54) SUBDIVIDING APPARATUS FOR AEROSOL CONTAINER

(75) Inventor: Kazunori Hoshino, Zushi (JP)

(73) Assignee: Toyo Aerosol Industry Co., Ltd., Tokyo (JP)

( * ) Notice: Subject to any disclaimer, the term of this patent is extended or adjusted under 35 U.S.C. 154(b) by 0 days.

(21) Appl. No.: 09/437,401

(22) Filed: Nov. 10, 1999

(51) Int. Cl.[7] ..... B65D 83/20
(52) U.S. Cl. ..... 222/402.2
(58) Field of Search ..... 222/402.2, 61

(56) References Cited

U.S. PATENT DOCUMENTS

| | | | | |
|---|---|---|---|---|
| 2,945,494 | * | 7/1960 | Bowen | 222/402.2 X |
| 3,138,301 | * | 6/1964 | Ward | 222/402.2 X |
| 3,221,946 | * | 12/1965 | Riley | 222/402.2 X |
| 4,577,784 | * | 3/1986 | Brunet | 222/402.2 |
| 5,520,310 | * | 5/1996 | Bauer et al. | 222/402.2 |

FOREIGN PATENT DOCUMENTS

| | | |
|---|---|---|
| 2 730 219 | 8/1996 | (FR) . |
| 975 287 | 7/1963 | (GB) . |
| 50-11607 | 5/1975 | (JP) . |
| 5-29510 | 4/1993 | (JP) . |

* cited by examiner

*Primary Examiner*—Kenneth Bomberg
(74) *Attorney, Agent, or Firm*—Kanesaka & Takeuchi

(57) ABSTRACT

A subdividing apparatus for aerosol container for aerosol contents includes a fixed amount chamber formed in an apparatus body disposed with a stem of the aerosol container, and a piston capable of pressing the aerosol contents introduced in the fixed amount chamber is slidably attached in the apparatus body. A subdividing nozzle that can spray the aerosol contents in the fixed amount chamber is formed as to connect with the apparatus body via a subdividing valve. With the subdividing apparatus, spraying in a fixed amount in a prescribed period can be done with multiple spraying operations from the subdividing nozzle to limit overuse of, e.g., medicines and cosmetics.

5 Claims, 6 Drawing Sheets

SUBDIVIDING APPARATUS FOR AEROSOL CONTAINER

BACKGROUND OF THE INVENTION

This invention relates to a subdividing apparatus for an aerosol container for dispensing a fixed amount of an aerosol content, such as a cosmetic material, which has a limited amount of use in a predetermined period, such as a day, several days, or a week.

As a fixed quantity spraying valve, which always provides a constant amount of an aerosol content at a single spraying operation, for example, Japanese Patent Publication (KOKOKU) Showa No. 50-11607, Japanese Patent Publication (KOKOKU) Heisei No. 5-29510 have been known. The mechanisms of the fixed quantity spraying valves in such conventional art have advantages to provide a constant spraying amount of the aerosol content at a single spraying operation.

However, those mechanisms may not always be suitable for an aerosol content for medicine or hair tonic, to be used at several spraying operations, for example, three times, i.e. morning, noon and evening, in a day, though a daily use amount is already determined.

That is, with the conventional fixed quantity spraying valves, an entire amount of the aerosol content measured to have a fixed amount is used for one spraying. However, in case a fixed amount of the aerosol content is divided into multiple times and is used for a prescribed period, such as a day or a week, the user may forget the used number of times, and therefore, the fixed amount may not be consumed, or the use may use in excess, resulting in unfavorable effects in terms of drug therapy.

It is an object of the invention to provide a subdividing apparatus for spraying a content divided into multiple times in a prescribed period, such as a day or a week, in surely maintaining the use amount of medicine or cosmetic which limit the use amount in the prescribed period, to solve the above problems.

SUMMARY OF THE INVENTION

A subdividing apparatus for an aerosol container for containing an aerosol content according to this invention, for solving the above problems, includes an apparatus body with a stem capable of being pushed; a fixed amount chamber communicating with the stem, the fixed amount chamber being formed in the apparatus body; a piston slidably mounted in the apparatus body for pressing the aerosol content introduced in the fixed amount chamber; and a subdividing nozzle formed to communicate with the fixed amount chamber to be able to spray the aerosol content placed in the fixed amount chamber and to connect with the apparatus body via a subdividing valve.

In a preferred embodiment, the subdividing valve is a fixed amount valve for spraying the aerosol content at a fixed amount, and the piston may be urged to the aerosol content by a spring.

The subdividing apparatus according to the invention may include an outer cylinder whose lower end is secured to the aerosol container; an inner cylinder inserted rotatively and vertically movably in the outer cylinder, the inner cylinder being capable of pushing the stem by engagement of an outer peripheral projection of the inner cylinder with a groove cam opened in a circumferential direction of the outer cylinder, the inner cylinder including the fixed amount chamber and the piston therein; and a securing member covering a top end of the inner cylinder.

Since the invention is thus structured, when the apparatus body is pushed to press the stem of the aerosol container, a control valve of the aerosol container is opened. An aerosol content is introduced into the fixed amount chamber through the stem by opening of the control valve of the aerosol container.

As the aerosol content is introduced, the piston is pressed by spraying pressure of the aerosol content and is moved up, thereby introducing the aerosol content into the fixed amount chamber up to an upper limit in the piston. Because the introduction of the aerosol content is stopped at the upper limit of the piston, the fixed amount chamber is filled always with the aerosol content in the fixed amount by a single pushing operation of the apparatus body.

After completion of the introduction of the aerosol content into the fixed amount chamber, the stem of the aerosol container is released from pressing with respect to the apparatus body. In this released state, the communication of the fixed amount chamber is shut off with the interior of the aerosol container, and at the same time, the communication between the fixed amount chamber and the exterior of the apparatus body is shut off by the subdividing valve.

In case the stem of the subdividing valve communicating with the fixed amount chamber is pushed by a push bottom or the like, the aerosol content is sprayed outside from the subdividing nozzle. When the aerosol content is sprayed through the subdividing valve, the fixed amount chamber does not communicate with the interior of the aerosol container by means of the control valve, so that the only aerosol content filled in the fixed amount chamber is sprayed. Accordingly, an amount greater than the amount in the fixed amount chamber is not sprayed even if the spraying operation is made in multiple times in spraying the aerosol content through the subdividing valve.

The spraying pressure of the aerosol content in the fixed amount chamber is reduced because the aerosol content becomes less in volume according to the continuous spraying from the subdividing nozzle to the exterior. However, because the piston always presses the aerosol content in the fixed amount chamber, pressure reduction of the aerosol content is minimum, so that the subdivision nozzle may not raise any problem to spray the aerosol content.

Accordingly, in case the amount of the aerosol content in the fixed amount chamber is set to the used amount during a prescribed period, such as a day or a week, the entire amount can be used within the prescribed period by spraying from the fixed amount chamber the aerosol content for the amounts and time as the user thinks necessary, so that the aerosol content may not be used excessively.

As a result, the subdividing apparatus according to the invention is suitable for medicine or cosmetic having a limited use amount in a prescribed period. In case the fixed amount of the content is used in the prescribed period and the aerosol content in the fixed amount chamber is sprayed completely, next aerosol content is introduced into the fixed amount chamber in opening the control valve of the aerosol container by pushing the apparatus body when entering in the subsequent prescribed period. By spraying the content with the subdividing nozzle, the aerosol content can be used on the basis of the fixed amount in the prescribed period.

If a fixed amount valve is used for the subdividing valve connecting with the fixed amount chamber, multiple spraying operations can be done at fixed amounts through the subdividing nozzle from the fixed amount chamber, so that further better spraying operation can be obtained.

DETAILED DESCRIPTION OF PREFERRED EMBODIMENTS

Referring to FIGS. 1 to 6, a subdividing apparatus for an aerosol container according to an embodiment of the invention is described. Numeral 1 is an aerosol container, and a control valve 3 is disposed on an inner surface of a mounting cup 2 at a top end of the aerosol container 3. The control valve 3 has a structure not specifically limited as far as the aerosol content can be sprayed to the exterior from a stem 4 upon pressing of the stem 4.

Figure 2:
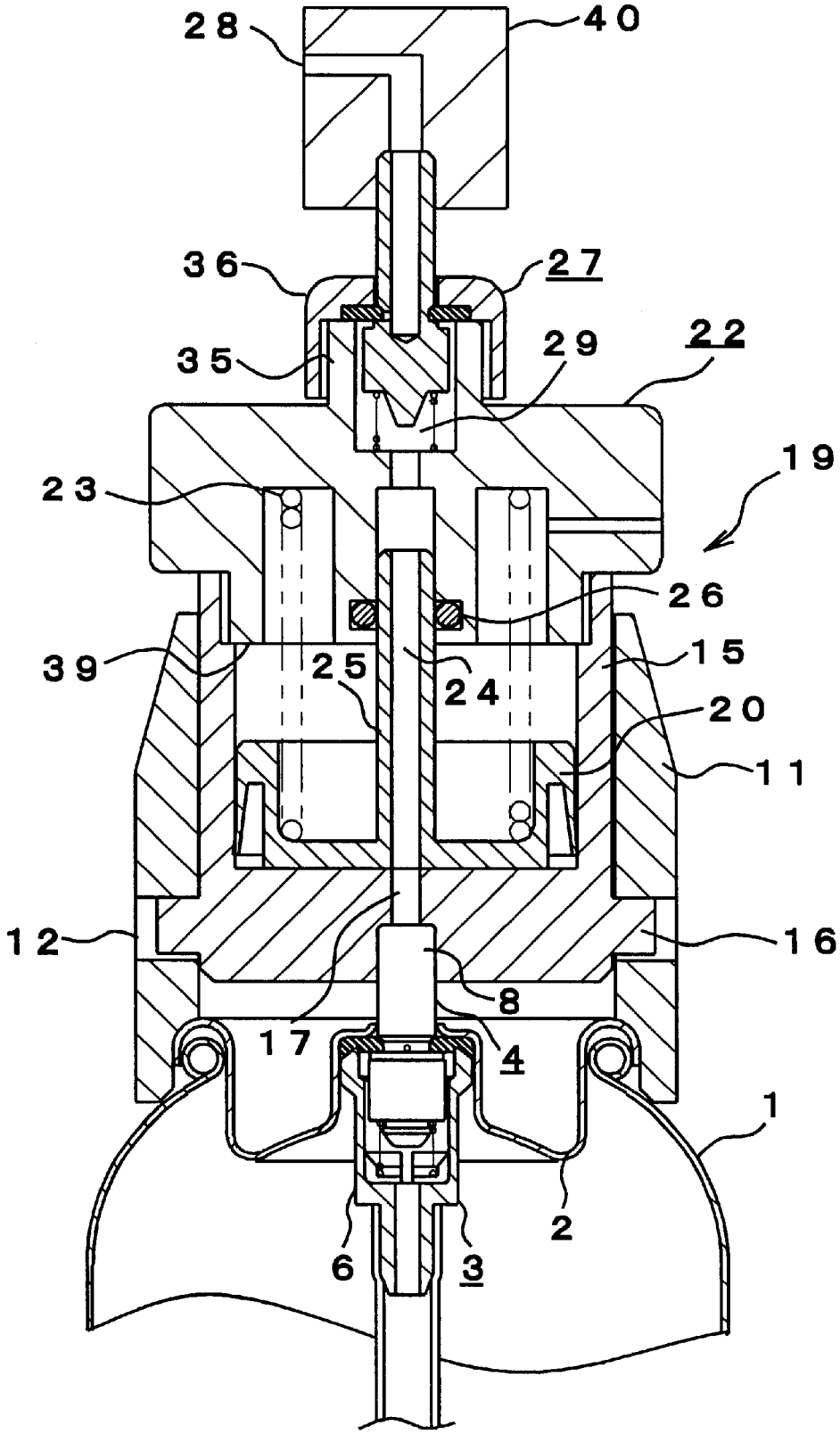
FIG. 2 is a cross sectional view showing the subdividing apparatus in a state before the aerosol content is introduced into a fixed amount chamber.
Figure 5:
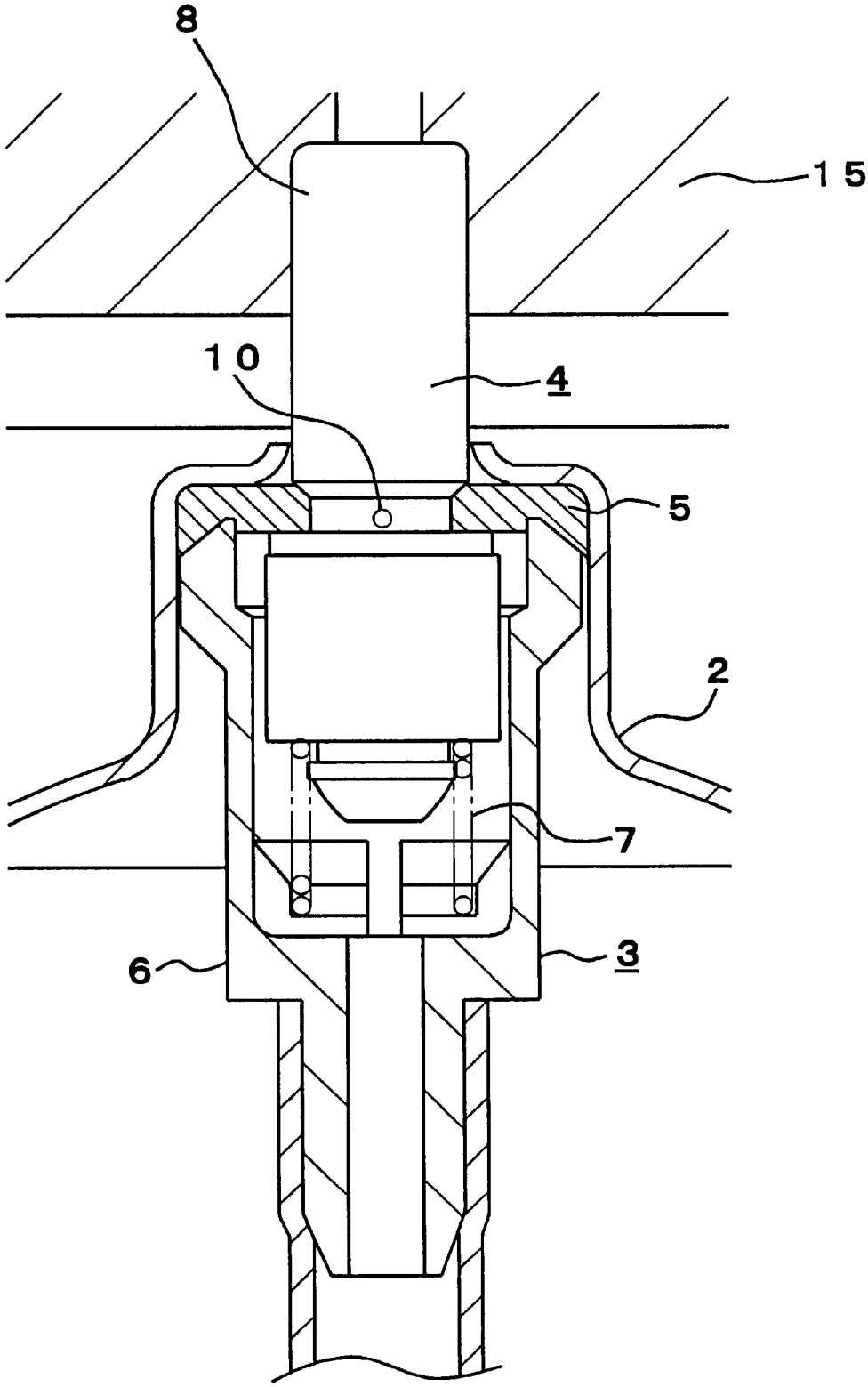
FIG. 5 is an enlarged cross sectional view showing a control valve of the aerosol container.

In this embodiment, as shown in FIGS. 2 and 5, a top of a housing 6 is secured to the inner surface of the mounting cup 2 via a stem gasket 5, and a stem 4 is inserted in the housing 6. The stem 4 is urged upwardly by a stem spring 7, and a top end 8 projects upwardly through the stem gasket 5. The stem gasket 5 normally seals an orifice 10.

Figure 4:
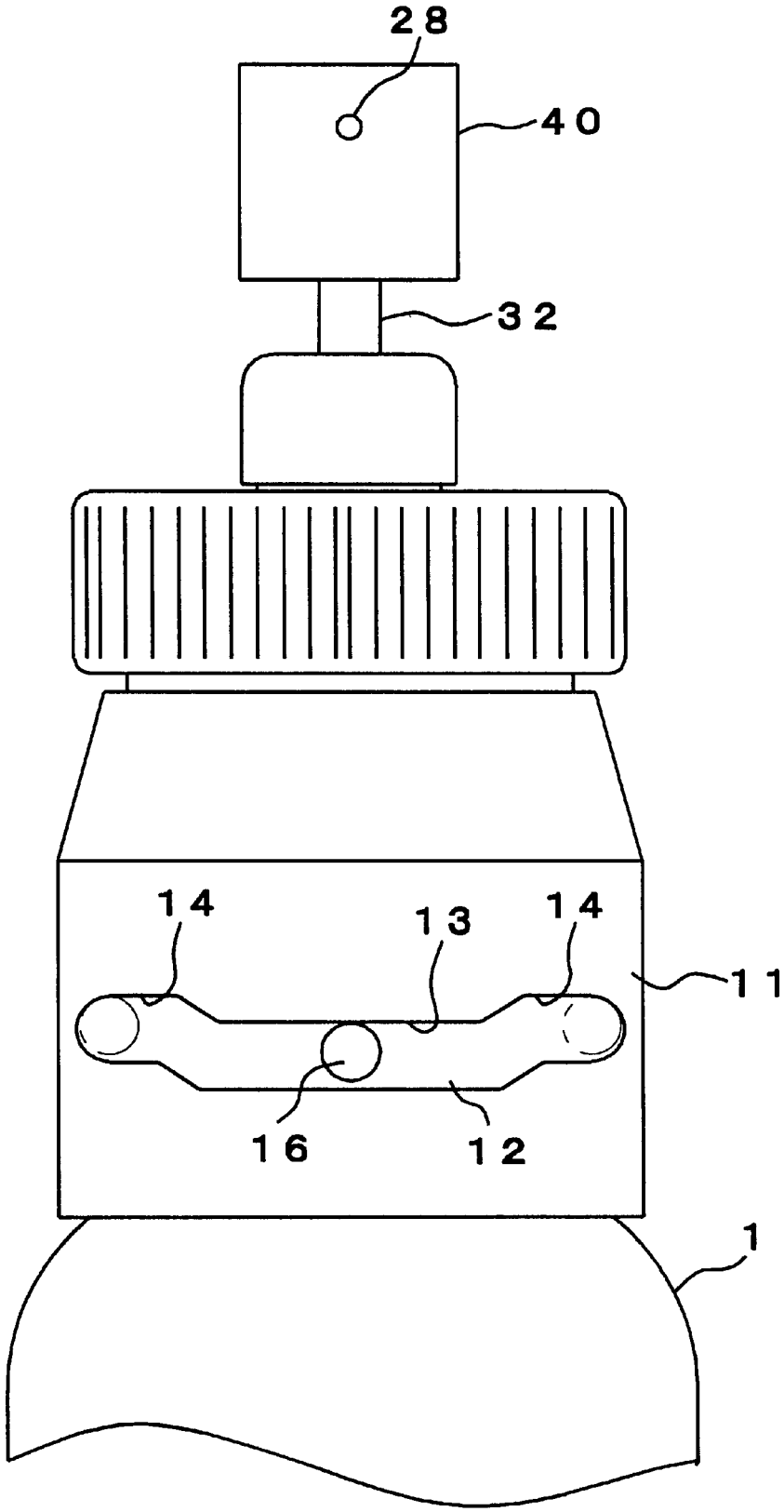
FIG. 4 is a front view showing a groove cam provided on an outer cylinder of the subdividing apparatus.

A lower end of an outer cylinder 11 in a cylindrical shape is fitted and secured to an outer periphery of the top end of the aerosol container 1. Groove cams 12 are formed as shown in FIG. 4 to extend in a circumferential direction of the outer cylinder 11. The groove cam 12 has a spraying operation portion 13 located closer to the aerosol container 1 and non-spraying portions 14 located on far sides of the aerosol container 1.

An inner cylinder 15 is attached inside the outer cylinder 11 so as to be slidable in the up and down directions and pivotally movable in a circumferential direction. Outer periphery projections 16 project from the outer periphery of the inner cylinder to fit in the groove cams 12. The inner cylinder 15 is coupled at a lower end to the stem 4 of the aerosol container 1, and forms inside thereof a fixed amount chamber 18 communicating with the stem 4 through a communication passage 17.

A piston 20 is slidably attached to the inside of the fixed amount chamber 18. The piston 20 is urged in a direction contracting the fixed amount chamber 18 within the fixed amount chamber 18 by providing a spring 23 between the inner cylinder 15 and a securing member 22 screwed to a top of the inner cylinder 15 via a threading portion 21. The spring 23 has a pushing force slightly smaller than the spraying pressure of the propellant filled in the aerosol container 1. An apparatus body 19 is formed of the outer cylinder 11, the inner cylinder 15, and the securing member 22.

The piston 20 has an introduction path 24 for an aerosol content extending vertically at a center of the piston 20. An introduction pipe 25 of the piston 20 in which the introduction path 24 is formed is inserted in the securing member 22, thereby forming the introduction pipe 25 slidable in the securing member 22. The introduction pipe 25 has an O-ring 26 placed between the outer peripheral surface and the inner peripheral surface of the securing member 22, and placed within the securing member 22.

A subdividing valve 27 is arranged at a top end of the securing member to communicate with the introduction path 24 of the piston 20. A subdividing nozzle 28 is formed via the subdividing valve 27. The subdividing valve 27 forms a subdividing fixed amount chamber 29 which normally communicates with the introduction path 24. A subdividing stem 32 in the subdividing fixed amount chamber 29 is arranged to be normally urged in an external direction by a subdividing spring 31.

The subdividing stem 32 is normally closed at a subdividing orifice 33 by a gasket 34. The gasket 34 blocks the communication between the fixed amount chamber 29 and the subdividing nozzle 28. The gasket 34 is arranged at a top end of a cylindrical tube 35 projecting from an outer periphery of the securing member 22, and the top of the gasket 34 is covered by and secured to a cover 36 firmly screwed to the cylindrical tube 35. The cover 36 and the cylindrical tube 35 form the subdividing fixed amount chamber 29. The subdividing stem 32 has a stopper plug 37 projecting downward at the lower end of the stem 32, to be able to close a communication passage 38 between the introduction path 24 extending at the lower end of the subdividing fixed amount chamber 29 and the fixed amount chamber 18.

Figure 3:
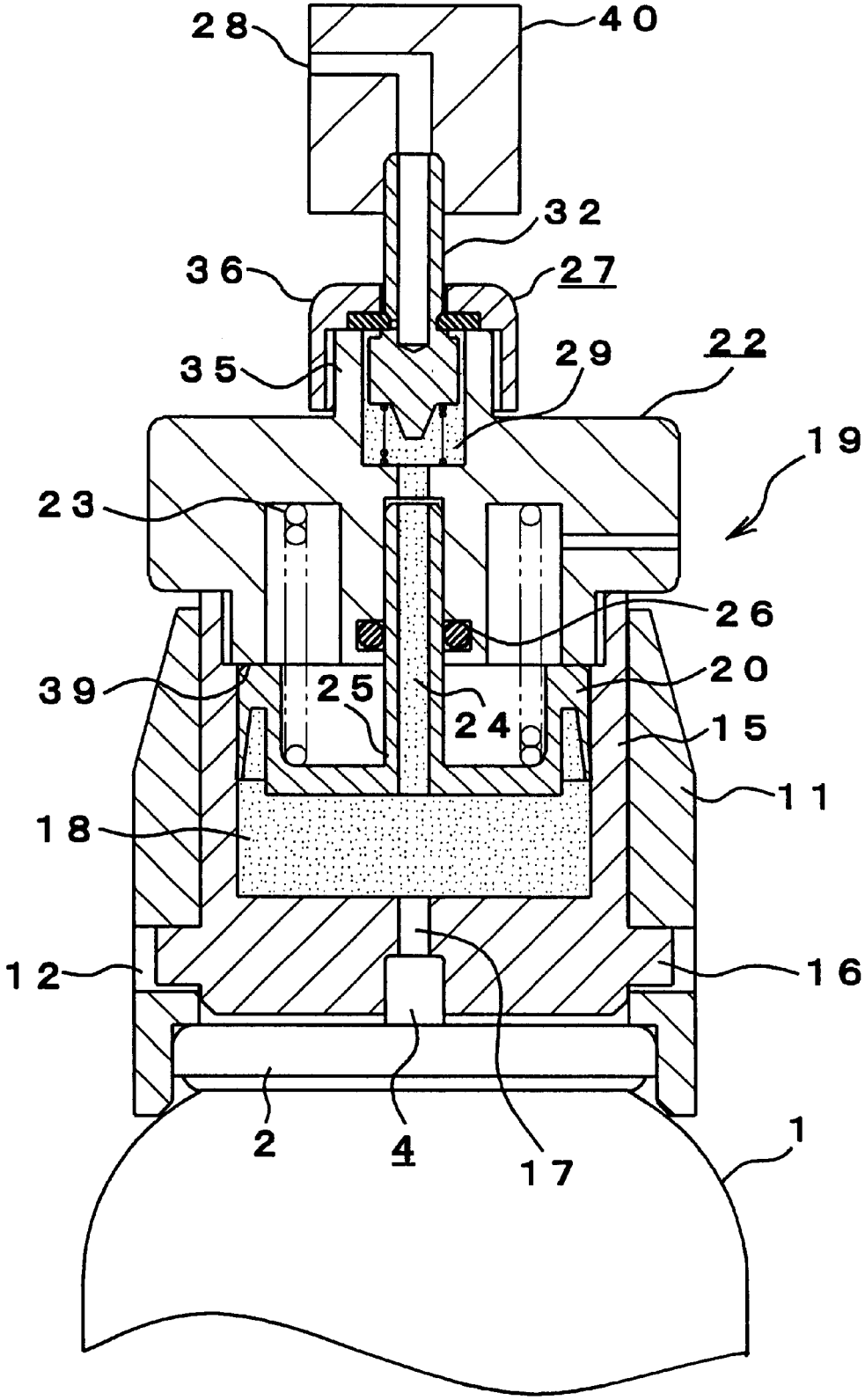
FIG. 3 is a cross sectional view showing the subdividing apparatus in a state that the aerosol content is introduced into the fixed amount chamber.

With the subdividing apparatus thus structured, to spray the aerosol content in a subdividing manner, first, the inner cylinder 15 is moved through the securing member 22. The outer periphery projections 16 projecting from the outer periphery of the inner cylinder 15 are moved to the spraying operation portions 13 of the groove cam 12. According to the sliding of the outer periphery projections 16 to the spraying operation portions 13, the stem 4 of the aerosol container 1 is pushed to open the control valve 3 of the aerosol container 1, thereby allowing the aerosol content filled in the aerosol container 1 to flow into the fixed amount chamber 18 of the inner cylinder 15 through the communication passage 17 as shown in FIG. 3.

Because the aerosol content pushes the piston 20 with a pressure slightly stronger than a returning force of the spring 23 of the piston 20, the piston 20 moves up opposite to the returning force of the spring 23 and introduces the aerosol content into the fixed amount chamber 18. The top end of the introduction pipe 25 abuts against the top end of the securing member 22, thereby stopping the upward movement of the piston 20. Alternatively, as shown in FIG. 3, the upward movement of the piston 20 can be stopped by hitting the lower opening edge 39 of the securing member 22 as shown in FIG. 3. This stop of the upward movement of the piston 20 allows the aerosol content to be filled in the fixed amount chamber 18 in a prescribed amount.

The aerosol content is filled not only in the fixed amount chamber 18 but also in the subdividing fixed amount chamber 29 of the subdividing valve 27 through the introduction path 24. The subdividing fixed amount chamber 29 does not spray the aerosol content outwardly as it is because the gasket 34 seals the subdividing orifice 33 of the subdividing stem 32.

After the fixed amount of the aerosol content is filled in the fixed amount chamber 18 in a predetermined period, the securing member 22 is returned to the original position by holding the member with fingers or a hand, and the outer periphery projections 16 are returned to the non-spraying portions 14 of the groove cam 12, thereby releasing the pressure to the stem 4 exerted to the control valve 3 of the aerosol container 1. With this releasing of the pressure to the stem 4, the control valve 3 of the aerosol container 1 is closed, and the communication between the interior of the aerosol container 1 and the fixed amount chamber 18 is in turn closed.

Figure 1:
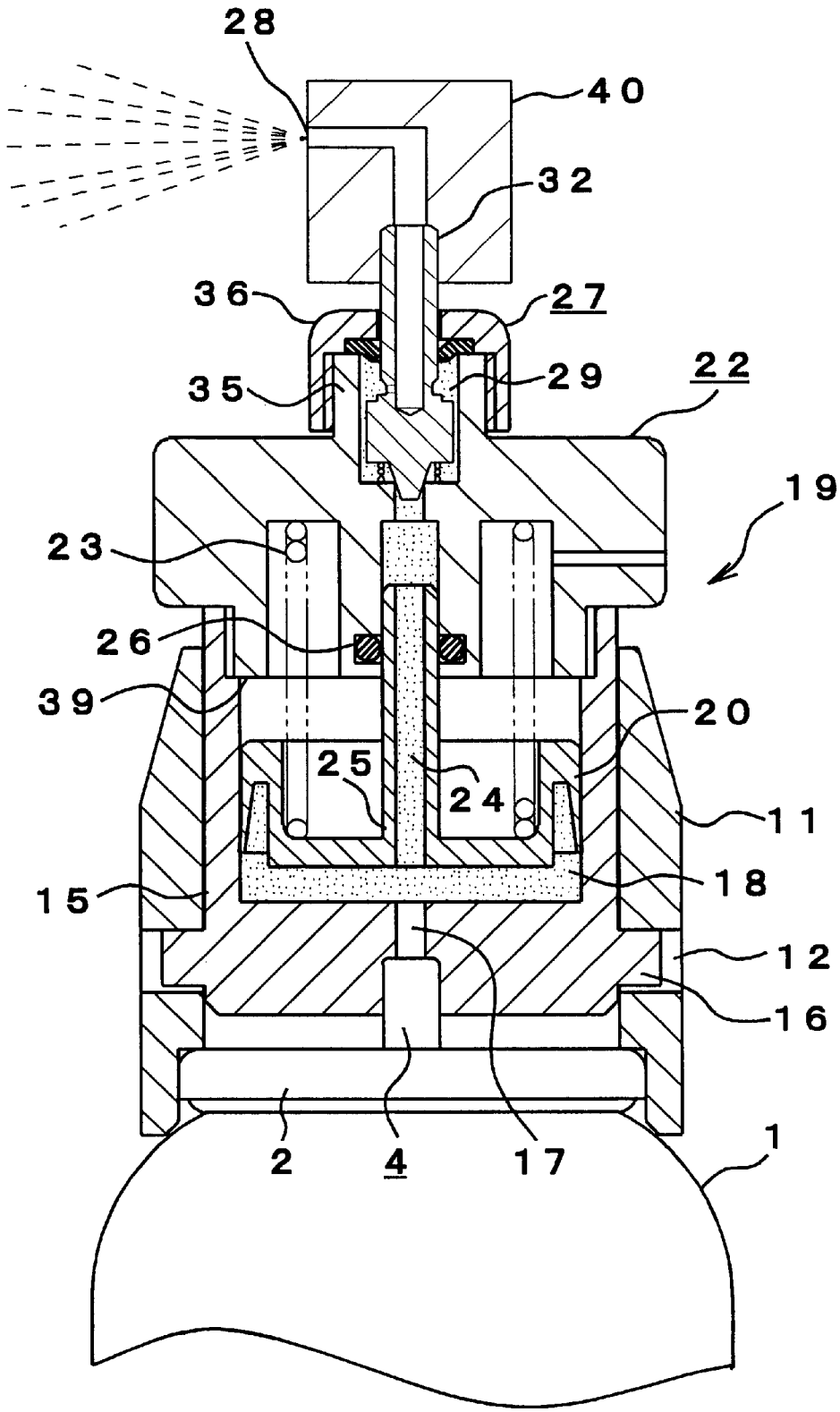
FIG. 1 is a cross sectional view showing a subdividing apparatus for an aerosol container according to the invention in a subdivided spraying state of the aerosol content.
Figure 6:
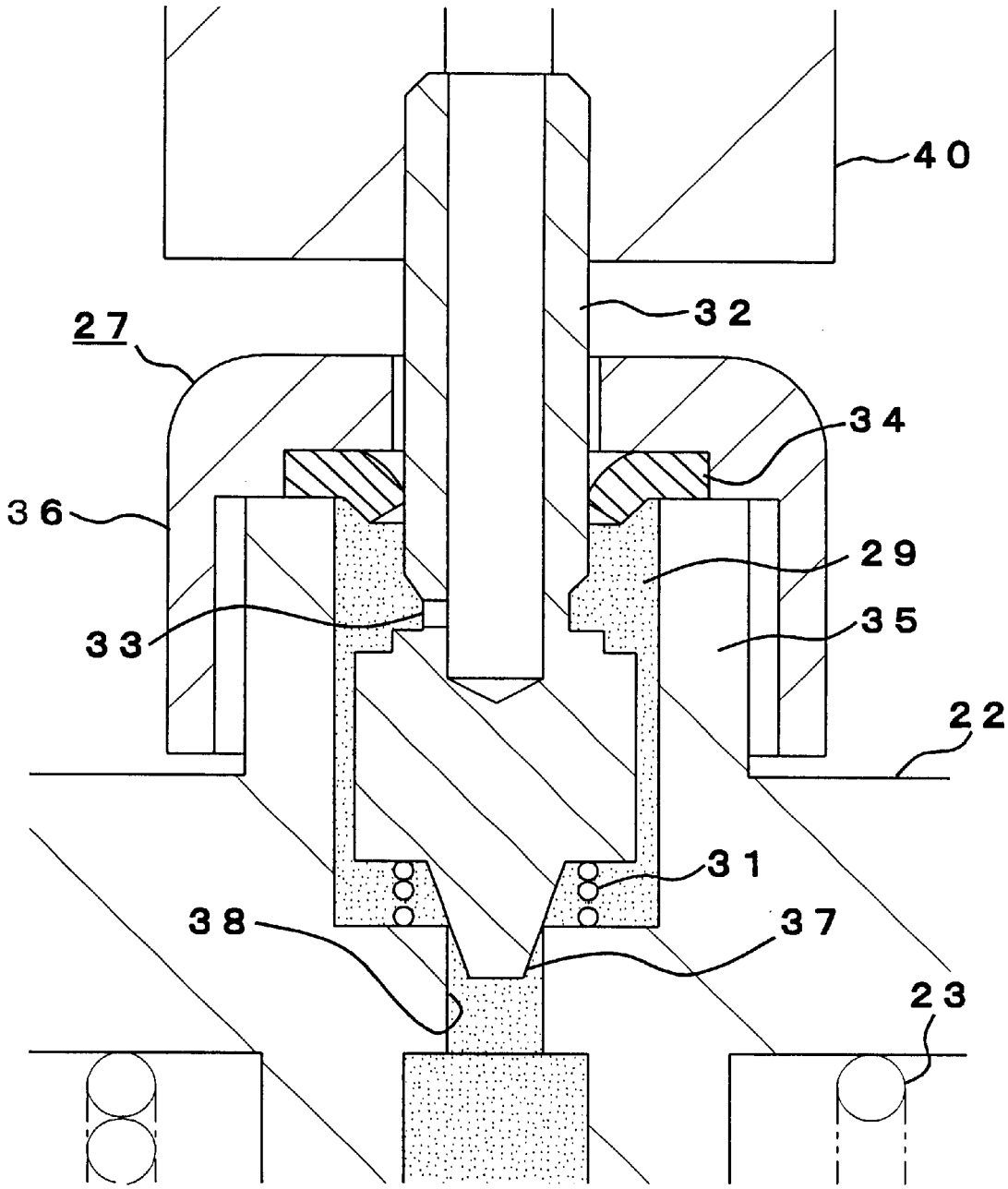
FIG. 6 is an enlarged cross sectional view showing a subdividing valve.

Subsequently, to use the apparatus by spraying the aerosol content outwardly, the subdividing nozzle 28 of the subdividing valve 27 is employed. The subdividing nozzle 28 is formed by connecting the subdividing stem 32 of the subdividing valve 27 with a push button 40 and the like. When the push button 40 is pressed, the aerosol content in the subdividing fixed amount chamber 29 is sprayed outside, by which the fixed amount chamber 18 comes to communicate through the communication passage 38, as shown in FIG. 1. This spraying is made by disengaging the subdividing orifice 33 of the subdividing stem 32 from the gasket 34 upon pressing operation of the subdividing stem 32, as shown in FIG. 6.

With this apparatus, spraying the aerosol content in a fixed amount can be made by adjusting the pushing amount of the subdividing stem 32 through the push button 40. For example, as shown in FIG. 6, if the push button 40 is strongly pushed until the limit of the pushing amount of the subdividing stem 32, the stopper plug 37 is inserted in the communication passage 38 communicating with the fixed amount chamber 18, thereby closing the communication passage 38. Therefore, the aerosol content sprayed from the subdividing nozzle 28 is limited to the aerosol content in the subdividing fixed amount chamber 29, so that the aerosol content sprayed from the subdividing nozzle 28 can be sprayed in a fixed amount.

In regard to the spraying operation of the aerosol content by means of the subdividing nozzle 28, because the amount of the aerosol content in the fixed amount chamber 18 is fixed, even if the aerosol content is sprayed in a fixed amount or in a non-fixed amount, the total sprayed amount of the aerosol content becomes the fixed amount even if the aerosol content is sprayed in several times from the subdividing nozzle 28 on the basis of the fixed amount or non-fixed amount from the subdividing nozzle 28.

Therefore, in case the spray amount of the aerosol content as the total is fixed to correspond to the spray amount for a day, several days, a week, or the like, spraying can be done always with the fixed amount for the prescribed period, such as a day. Accordingly, it is favorable to use for medicine, cosmetic, hair tonic, and the like, which requires to avoid excessive use.

Since the subdividing apparatus according to the invention is thus structured, spraying in the fixed amount in a prescribed period can be done in multiple times from the subdividing nozzle, and favorable subdivision of the aerosol content can be done for medicine and cosmetic that is not suitable for use in exceeding a limited amount in a prescribed period. Since the use amount in a prescribed period is specified, the user can arbitrarily adjust the use amount of each spraying operation during the prescribed period, so that the aerosol container can be used effectively.

The foregoing description of the preferred embodiment of the invention has been presented for the purpose of illustration and description, and is not intended to limit the invention to the precise form as disclosed. The description has been selected to best explain the principle of the invention and the practical application to enable others skilled in the art to best utilize the invention in various embodiments and various modifications as are suited to the particular use as contemplated. It is intended that the scope of the invention should not be limited by the specification, but be defined by claims set forth below.

What is claimed is:

1. A subdividing apparatus for an aerosol container containing aerosol content comprising:

an apparatus body having a stem and arranged so that the stem can be pushed, said apparatus body including an outer cylinder having a lower end to be secured to the aerosol container and a groove cam formed in a circumference thereof; an inner cylinder inserted rotatively and vertically movably in the outer cylinder and having an outer peripheral projection, the inner cylinder being capable of pushing the stem by engagement of the outer peripheral projection of the inner cylinder with the groove cam of the outer cylinder; and a securing member covering a top end of the inner cylinder;

a fixed amount chamber formed in the inner cylinder of the apparatus body and communicating with the stem;

a piston slidably mounted in the inner cylinder of the apparatus body for pressing the aerosol content introduced in the fixed amount chamber; and a subdividing nozzle connected to the apparatus body through a subdividing valve and communicating with the fixed amount chamber for spraying the aerosol content placed in the fixed amount chamber.

2. The subdividing apparatus for an aerosol container according to claim 1, wherein the subdividing valve sprays the aerosol content at a fixed amount.

3. The subdividing apparatus for an aerosol container according to claim 1, further comprising a spring for allowing the piston to push the aerosol content.

4. A subdividing apparatus for an aerosol container containing aerosol content comprising:

an apparatus body having a stem and arranged so that the stem can be pushed;

a fixed amount chamber formed in the apparatus body and communicating with the stem;

a piston slidably mounted in the apparatus body for pressing the aerosol content introduced in the fixed amount chamber;

a subdividing valve attached to the apparatus body and communicating with the fixed amount chamber;

a subdividing fixed amount chamber formed in the apparatus body and communicating with the fixed amount chamber, said subdividing valve being disposed in the subdividing fixed amount chamber; and a subdividing nozzle connected to the subdividing valve so that only when the subdividing nozzle is pushed, the subdividing valve is actuated to spray the aerosol content retained in the fixed amount chamber.

5. The subdividing apparatus for an aerosol container according to claim 4, wherein said apparatus body includes an outer cylinder to be secured to the aerosol container, an inner cylinder attached to the outer cylinder to rotate circumferentially and move vertically and containing the piston therein, and a securing member attached to the inner cylinder and having the subdividing fixed amount chamber therein.

* * * * *